US009359097B2

(12) United States Patent
Henriksson et al.

(10) Patent No.: US 9,359,097 B2
(45) Date of Patent: Jun. 7, 2016

(54) METHOD AND DEVICE FOR STRIPPING OF WRAPPING MATERIAL

(75) Inventors: Ola Henriksson, Falkenberg (SE); Jörgen Jensen, Köinge (SE); Nils Strandh, Gullbrandstorp (SE)

(73) Assignee: CORE LINK AB, Falkenberg (SE)

( * ) Notice: Subject to any disclaimer, the term of this patent is extended or adjusted under 35 U.S.C. 154(b) by 784 days.

(21) Appl. No.: 13/508,720

(22) PCT Filed: Nov. 9, 2010

(86) PCT No.: PCT/SE2010/000272

§ 371 (c)(1), (2), (4) Date: May 8, 2012

(87) PCT Pub. No.: WO2011/059371

PCT Pub. Date: May 19, 2011

(65) Prior Publication Data

US 2012/0222529 A1 Sep. 6, 2012

(30) Foreign Application Priority Data

Nov. 10, 2009 (SE) ..... 0901434

(51) Int. Cl.

*B26D 3/00* (2006.01)
*B65B 69/00* (2006.01)
*B26D 7/06* (2006.01)

(52) U.S. Cl.

CPC ..... *B65B 69/0033* (2013.01); *B26D 7/06* (2013.01); *B65B 69/00* (2013.01); *Y10T 83/0448* (2015.04); *Y10T 83/0453* (2015.04); *Y10T 83/05* (2015.04); *Y10T 83/8735* (2015.04)

(58) Field of Classification Search

CPC ..... B26D 7/06; B65B 69/00; B65B 73/00; B65B 43/26; B65B 69/0033

USPC ..... 83/130, 733, 924, 425, 39, 133; 53/381.1, 384.1, 381.4, 386.1

See application file for complete search history.

(56) References Cited

U.S. PATENT DOCUMENTS 2,752,998 A * 7/1956 Ferguson ..... 30/272.1
3,225,443 A * 12/1965 Young ..... 30/273

(Continued)

FOREIGN PATENT DOCUMENTS

EP 0592845 A1 4/1994

OTHER PUBLICATIONS

International Search Report in PCT/SE2010/000272 dated Feb. 10, 2011(English Translation Thereof).

*Primary Examiner* — Omar Flores Sanchez

(74) *Attorney, Agent, or Firm* — McGinn IP Law Group PLLC

(57) ABSTRACT

A method and device of stripping of wrapping material including a tool having a first tool portion, a second tool portion, and a third tool portion comprising ends and a casing on substantially cylindrical rolls of paper and the like, in which the end of the wrapping material is opened by engagement by means of a first tool portion from some position on the end surface for processing the end wrapping material by cutting, slicing, and/or sawing of the end wrapping material in a direction out towards the periphery of the end where the end connects to the casing, the end being separated from the casing by means of the first tool portion or a second tool portion by cutting, slicing, sawing during rotation of the roll and/or displacement of the first tool portion or the second tool portion around the periphery of the end.

11 Claims, 7 Drawing Sheets

(56) References Cited

U.S. PATENT DOCUMENTS

| | | | | | |
|---|---|---|---|---|---|
| 3,329,046 | A | * | 7/1967 | Hilton | 81/9.51 |
| 3,889,442 | A | * | 6/1975 | Grahn et al. | 53/492 |
| 3,972,117 | A | * | 8/1976 | Fogg | 30/287 |
| 4,158,417 | A | * | 6/1979 | Inoue | 414/412 |
| 4,344,268 | A | * | 8/1982 | Wakamatsu et al. | 53/381.2 |
| 4,437,223 | A | * | 3/1984 | Petros | 29/564.3 |
| 4,746,259 | A | * | 5/1988 | Boucherie | 414/412 |
| 4,997,329 | A | * | 3/1991 | Hanamoto et al. | 414/412 |
| 5,060,456 | A | * | 10/1991 | Wehrli | 53/492 |
| 5,318,399 | A | * | 6/1994 | Marom | 414/412 |
| 5,467,676 | A | * | 11/1995 | Hooper et al. | 83/24 |
| 5,752,359 | A | * | 5/1998 | Oord | 53/381.2 |
| 5,928,073 | A | * | 7/1999 | Andersson et al. | 452/50 |
| 5,992,286 | A | * | 11/1999 | Boole | 83/856 |
| 6,059,647 | A | * | 5/2000 | Imaura | 452/50 |
| 6,453,787 | B2 | * | 9/2002 | Yamauchi | 83/733 |
| 6,656,031 | B1 | * | 12/2003 | Andersson | 452/50 |
| 6,725,631 | B2 | * | 4/2004 | Skrak et al. | 53/492 |
| 7,021,033 | B2 | * | 4/2006 | Close et al. | 53/492 |
| 7,174,695 | B2 | * | 2/2007 | Porter et al. | 53/381.2 |
| D616,719 | S | * | 6/2010 | Moore | D8/105 |
| 2003/0019345 | A1 | * | 1/2003 | Platon et al. | 83/733 |
| 2007/0170293 | A1 | | 7/2007 | Colombo et al. | |
| 2008/0022633 | A1 | * | 1/2008 | Porter et al. | 53/381.2 |
| 2011/0000171 | A1 | * | 1/2011 | Daughtry | 53/492 |

* cited by examiner

METHOD AND DEVICE FOR STRIPPING OF WRAPPING MATERIAL

The present invention relates to a method according to the preamble to appended claim 1 and a device for carrying the method into effect.

Hitherto, the stripping of wrapped rolls has taken place manually using knives, saws, splitters or the like ever since paper or similar products began to be delivered in the form of rolls. In such instance, it is important to find the end surface of the roll at the transition between the casing of the wrapping and the end wall of the wrapping, carefully using a cutting tool and thereafter pass in the tool between the end wall of the wrapping and the end surface of the roll, whereafter the roll is rotated about its longitudinal axis while the cutting tool is held stationary, oscillated like a saw or is moved around the periphery of the end wall possibly during simultaneous rotation of the roll about its longitudinal axis, so that the end wall of the wrapping may be stripped off. For stripping off the casing of the wrapping material, the cutting tool is moved between the casing and the paper on the roll in its longitudinal direction, whereafter the casing is removed by rotation of the roll about its longitudinal axis. In attempts to strip off wrapping material by machine, the manual stripping off technique has been more or less copied, but prior art devices or machines have proved to be unreliable and difficult to operate satisfactorily. Further, prior art devices have resulted in considerable scrapping of damaged paper rolls, since even the most insignificant damage may result in web breakage and disruption in the subsequent machine process. The difficulties inherent in stripping of wrapping material by machine are largely attributable to suppliers using different types of wrapping material, the rolls being stored on their ends with different loadings which compress the wrapping material in different ways, etc. These variations in the wrapping material make it extremely difficult to strip off the wrapping material by machine or even automate the stripping process, since considerable care is required so that the end surface of the roll is not damaged. As was mentioned above, even the most insignificant damage may lead to web breakage and other disruptions in the subsequent process, which would entail scrapping of damaged rolls with considerable consequential costs for the user.

The task forming the basis of the present invention is to realise a method of the type disclosed by way of introduction and a device for carrying the method into effect.

This task is solved according to the present invention in that the method disclosed by way of introduction has been given the characterising features as set forth in appended Claim 1 and in that the device for carrying the method into effect has been given the characterising features as set forth in appended Claim 8.

The present invention makes for the realisation of a machine-stripping of the wrapping material on paper rolls without any major risk of the occurrence of damage to the end surfaces of the paper rolls. The machine-stripping of wrapping material according to the present invention may further very well be automated such that the stripping of wrapping material may be carried out without human resources inputs.

The present invention will be described in greater detail hereinbelow, with reference to the accompanying Drawings.

Figure 1:
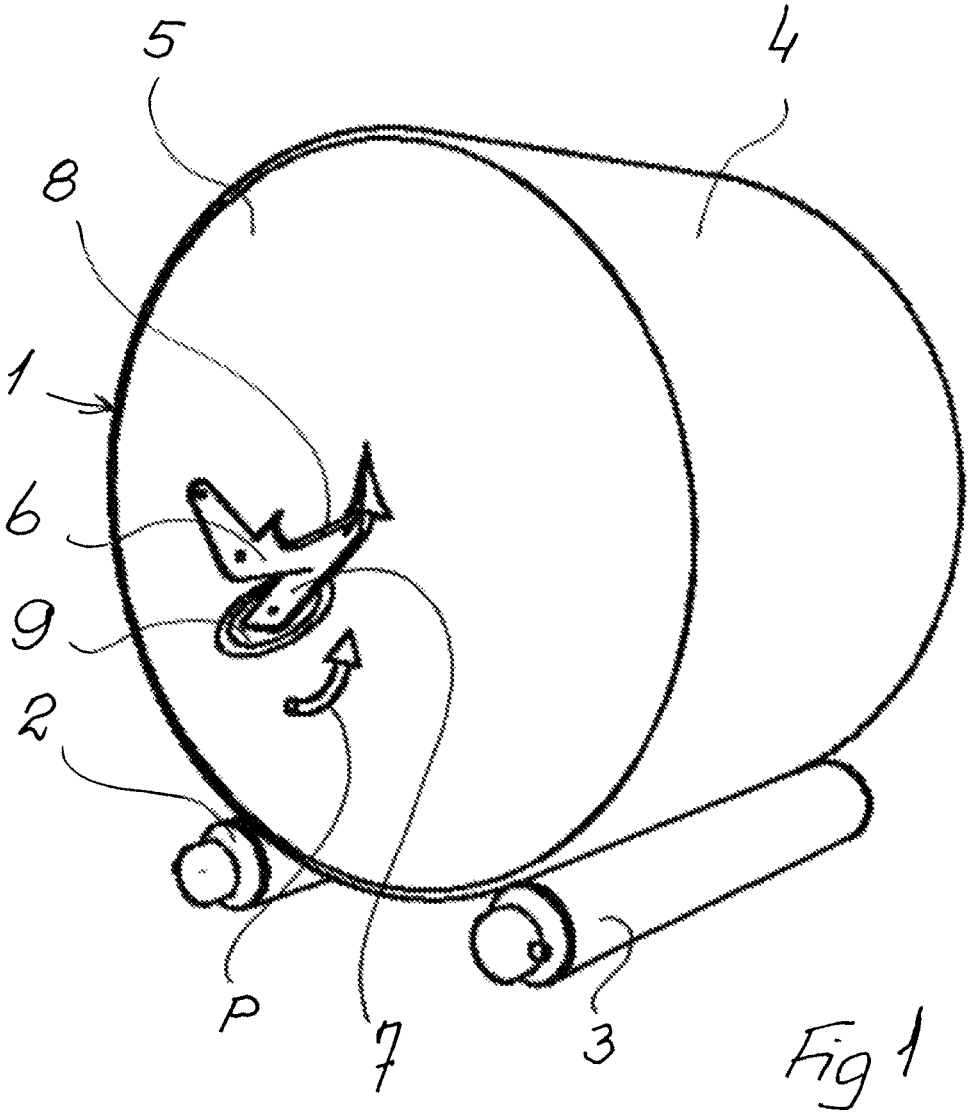
FIG. 1 is a perspective view of a part of a device according to one embodiment of the present invention, the part being shown in a starting position.

One embodiment of the method according to the present invention will be described in greater detail hereinbelow in connection with the stripping of wrapping material from a roll of paper or similar rollable material. A wrapped roll 1 is shown in FIG. 1 and rests on two cylinders 2 and 3 which may be free-going or driven. It is also possible to have the one cylinder 2 free-going and the other driven. The wrapping material comprises a casing 4 and two ends 5 of which only the one is shown in the Drawing figures.

Figure 2:
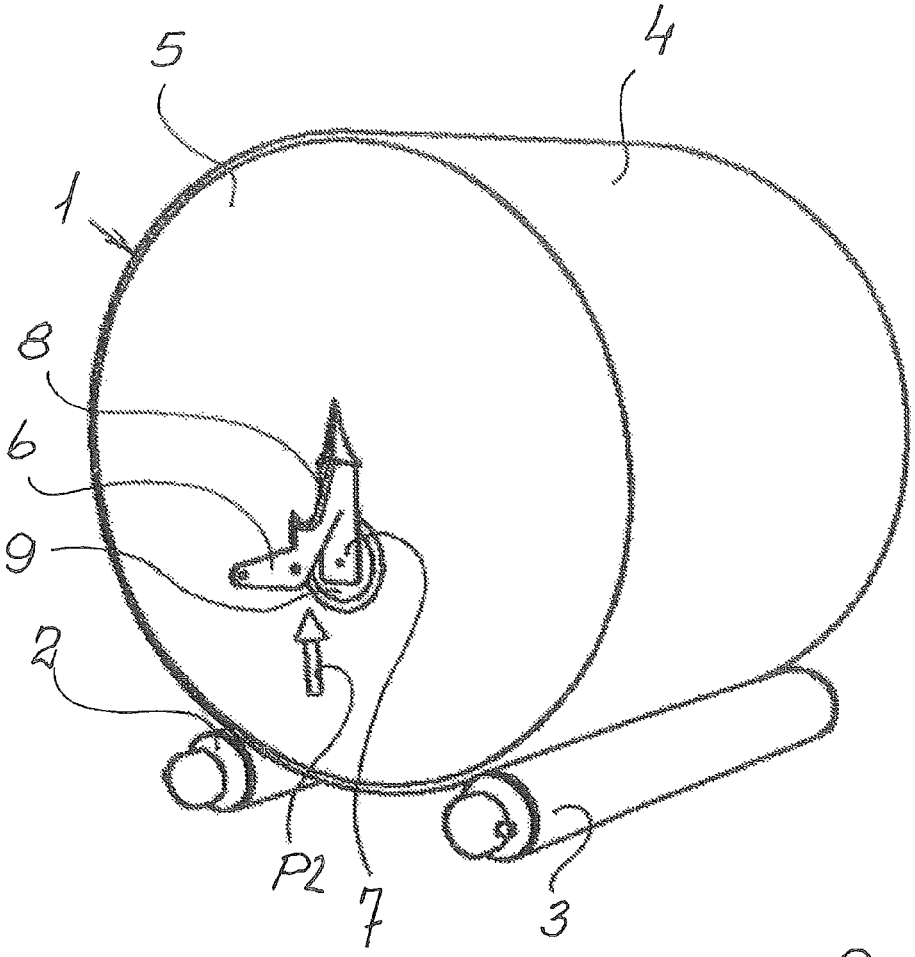
FIG. 2 is a perspective view of the part according to FIG. 1 in another position.

The stripping of the wrapping material is initiated in that a tool 6 is displaced by a pendulum arm (not shown) into engagement with the wrapping material in the end 5. The tool 6 has a bottom plate 7 and a cutting edge 8 projecting up from the plate 7, the rear portion of the edge being formed as a mounting portion for mounting the tool on the pendulum arm (not shown), the arm being disposed to pivot the tool 6 reciprocally to and from the end 5. The cutting edge 8 is further of J-shaped configuration bent towards the tip on the bottom plate 7. The bottom plate 7 is further provided with a wheel- or roller knife 9. It is appropriate if the pendulum arm is guided so that the tool 6 is pivoted towards the end 5 in accordance with the arrow P in FIG. 1 for engagement therein in a position where the roll located in the wrapping material 4 and 5 has its centre with a cardboard sleeve and possibly a plug. Engagement and penetration of the wrapping material in the end 5 in this position is the least risky, since the tool in this position runs no risk of coming into contact with the end surface of the paper proper on the roll in the packaging material. After the engagement and penetration of the wrapping material in the end 5, the tool 6 is pivoted by means of the pendulum arm until such time as the bottom plate 7 is substantially parallel with the paper end surface on the roll, as shown in FIG. 2, and is thereafter displaced in the direction of the arrow P2 via the position illustrated in FIG. 3 out towards the periphery of the end 5 while cutting up the wrapping material in the end 5 under the formation of the flaps F. The bottom plate 7 is planar and slightly bent upwards towards the tip in order for it to be located a distance from the end surface of the paper roll. The bottom plate 7 is also tipped like a ploughshare. The tool 6 may be displaced continually or stepwise reciprocally until it arrives at the position illustrated in FIG. 4 with the wrapping material in the end 5 cut up from the centre out to the periphery of the end 5 where the wrapping material in the casing 4 meets the wrapping material in the end 5. In FIG. 4 may be discerned the paper end surface on the roll 10 with its cardboard sleeve 11. In the peripheral position, the wheel or roller knife 9 is located with its centre substantially flush with the casing 4. This position is not an exact position, since it is possible to displace the tool 6 up and down (in a manner similar to a sewing machine needle) during cutting of the wrapping material in the end 5 from the wrapping material in the casing 4. In this cutting operation, the wrapped roll is rotated clockwise in a direction indicated by the arrow P3 on the cylinders 2 and 3. It is also possible to rotate the tool 6 around the periphery of the end 5 with or without rotation of the wrapped roll. After cutting of the end 5 along the periphery, this is removed for recycling of the wrapping material. The tool 6 includes the bottom plate 7 (i.e., the "first tool portion"), the wheel- or roller knife 9 (i.e., the "second tool portion"), and the cutting edge 8 (i.e., the "third tool portion"). In other words, the first tool portion, the second tool portion, and the third tool portion make up the tool.

In the event that the casing 4 is to be opened immediately after opening of the end 5, the tool 6 is switched with the tip on the bottom plate 7 towards the wrapping material edge formed after the cutting operation at the casing 4 for engagement between the edge and the paper on the roll 10 and the casing 4 is displaced from the illustrated end 5 to the opposing end (not shown) during cutting of the wrapping material in the casing 4.

The opposing end in relation to the illustrated end 5 is cut off by means of a tool 6 in the same manner which was described above simultaneously with the end 5. In such an event, the stripping of wrapping material is complete after the cutting of the casing 4 in accordance with the preceding paragraph. The wrapping material from the end and the casing 4 is taken care of for recycling.

Figure 3:
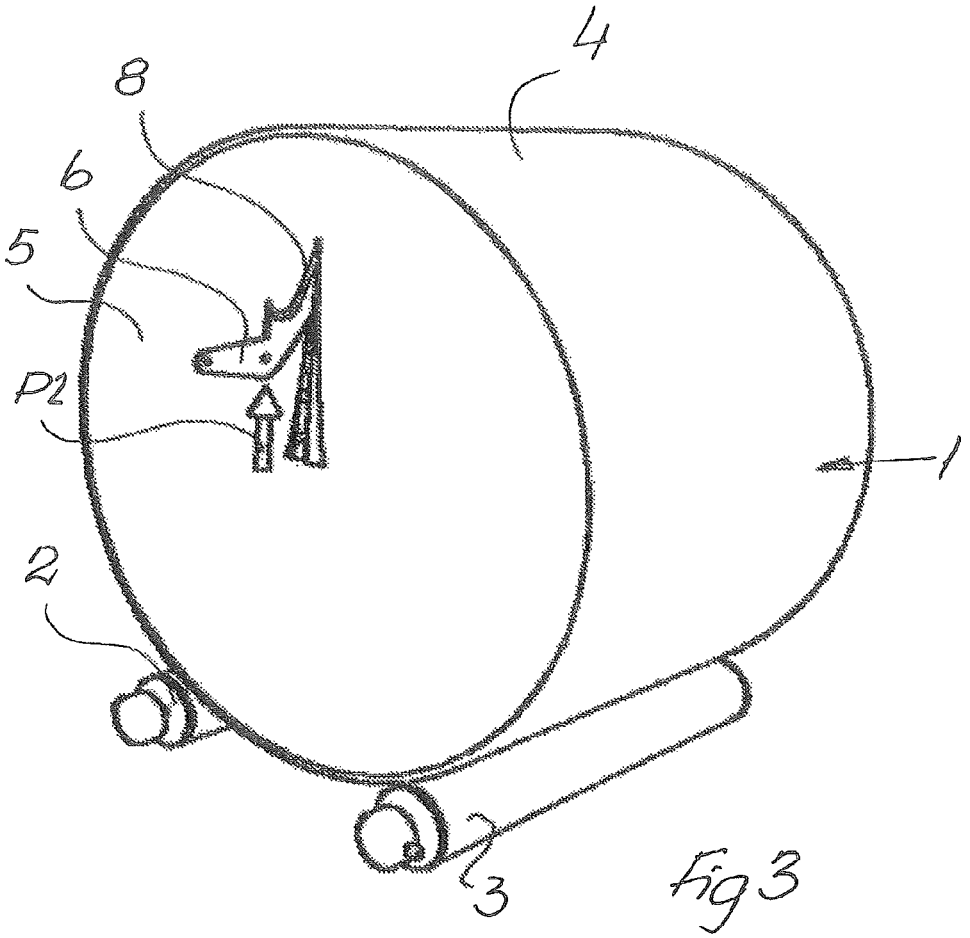
FIG. 3 is a perspective view of the part in a further position.
Figure 4:
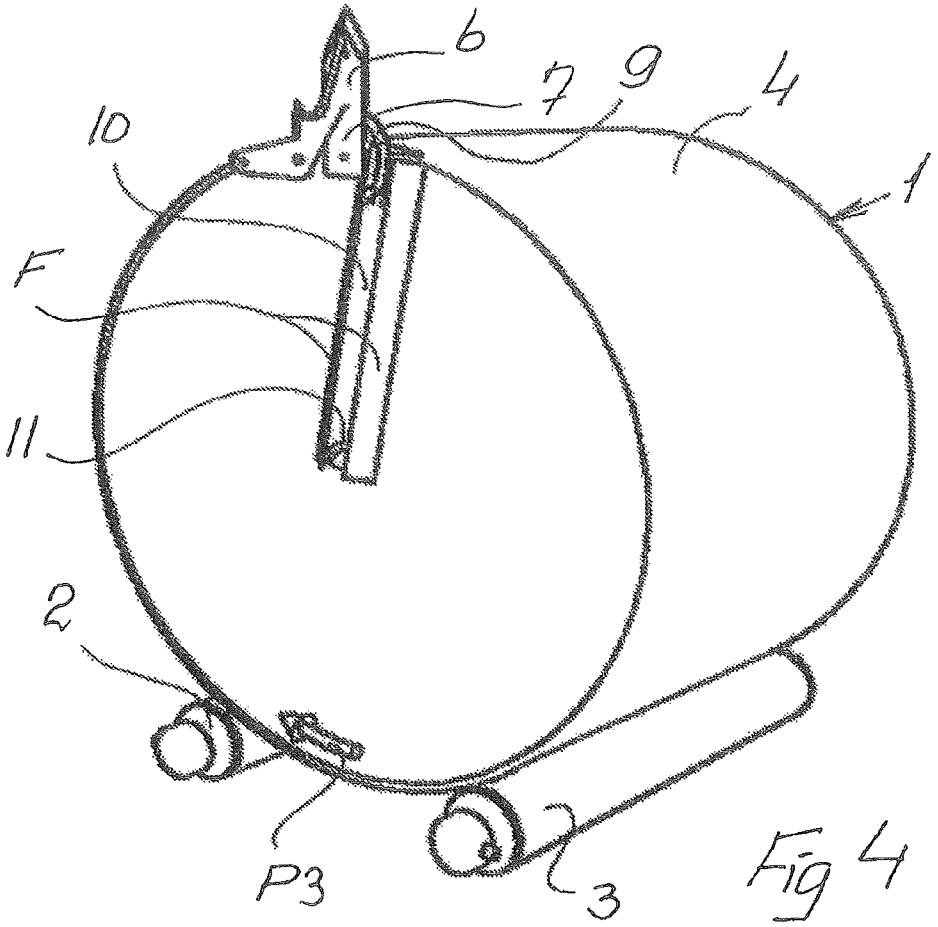
FIG. 4 is a perspective view of the part in yet a further position.

In another embodiment, the cylinders 2 and 3 are disposed on a platform for rotation of the wrapped roll half a revolution for positioning of the opposite end in relation to the end 5 illustrated in FIGS. 1-3 in the position illustrated in FIGS. 1-3 and cutting off in compliance with the foregoing. There may also be provided a device with a pendulum arm and tool 6 at both ends for simultaneous cutting of both of the ends.

In a further embodiment, cutting off of the first end 5 takes place, whereafter cutting of the casing 4 is commenced substantially simultaneously with the cutting off of the opposite end so that this opposite end and the casing 4 will be finished substantially simultaneously.

The roller or wheel knife 9 may be a fixed knife with a cutting edge which makes an acute angle with the casing 4 in the cutting direction so that the wrapping material in the casing 4 is urged against the cutting edge during rotation of the roll against the tool 6.

It may also be possible to delay opening of the casing 4 to a later opportunity in those cases where it is desirable to utilise the casing 4 as a form of protection during displacement of the paper roll.

Figure 5:
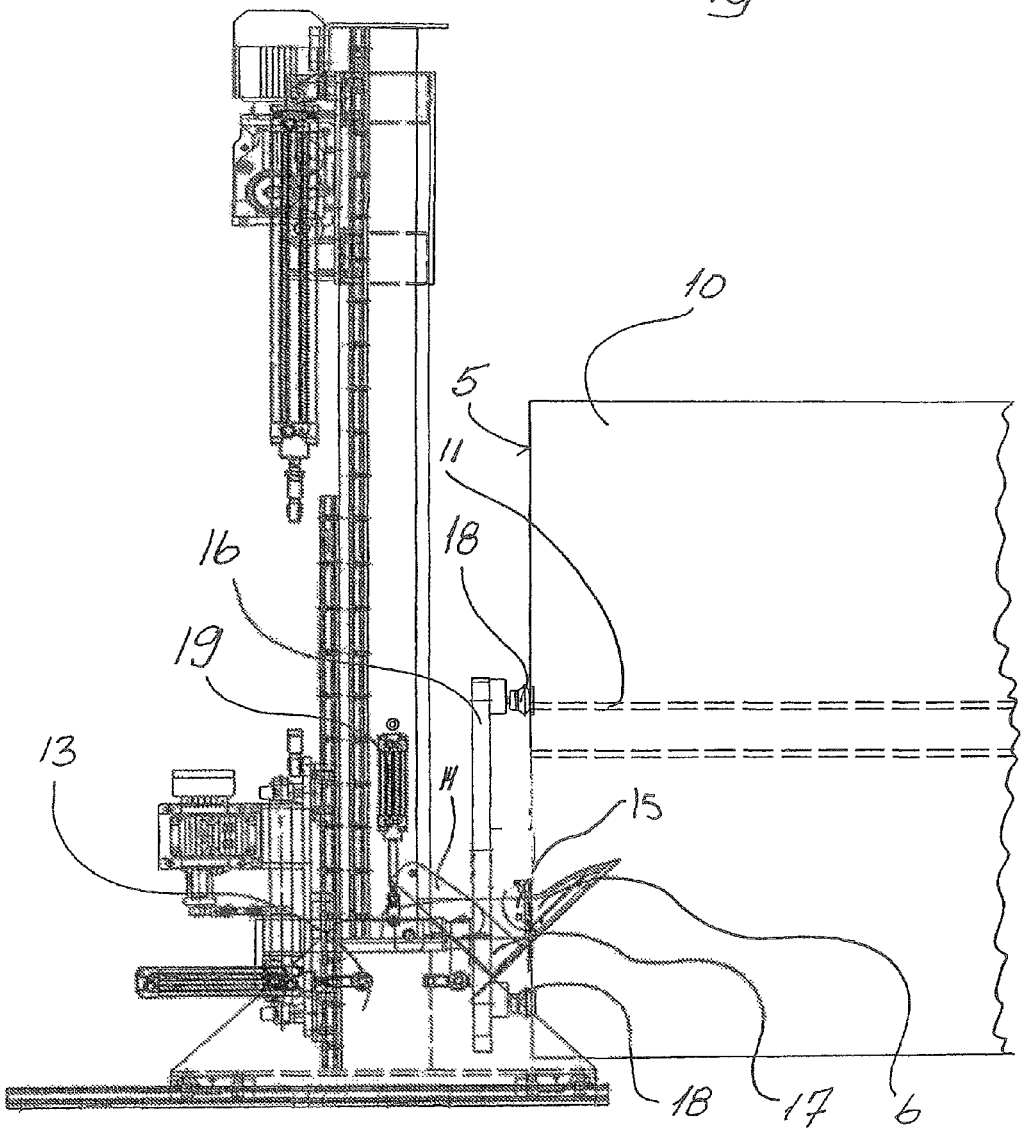
FIG. 5 is a side elevation of parts in a device according to one embodiment of the present invention.

In order to facilitate the engagement in the wrapping material of the end 5, it is appropriate to realise a lifting of the material from the end surface of the paper roll by establishing a pressure difference between the interior and exterior of the wrapping material using, for example, compressed air. It is also possible to pull or lift the ends out from the end surface of the paper roll by means of one or more suction cups, as illustrated in FIG. 5, where they are also used for positioning of the device with its tool 6 on the end. The suction cup or suction cups may also be used for dealing with the cut-off end.

FIG. 5 shows parts of a prototype of a device according to the present invention which is located at the one end 5 of a wrapped paper magazine roll 10 with a sleeve 11. The paper roll 10 rests on cylinders (not shown). The device in FIG. 4 is built up on a carriage 13 for moving the device to and from the end 5. The tool 6 is mounted on a pendulum arm 14 and is shown in two different positions, in the one of which positions the tool 6 is set at an angle to the end surface of the paper roll 10 before engagement in the centre of the roll 10, and thereafter switching to the second illustrated position in which the tool 6 is parallel with the end surface of the paper roll 10 for cutting up of the wrapping material in the end 5. The pendulum arm 14 is mounted on a plate 15 which may be displaced along the end 5. On the plate 15, there are disposed arms 16 and 17 for supporting suction cups 18. The device is suitably provided with four arms each with a suction cup. A piston and cylinder assembly 19 is provided for switching of the pendulum arm 14.

Figure 6:
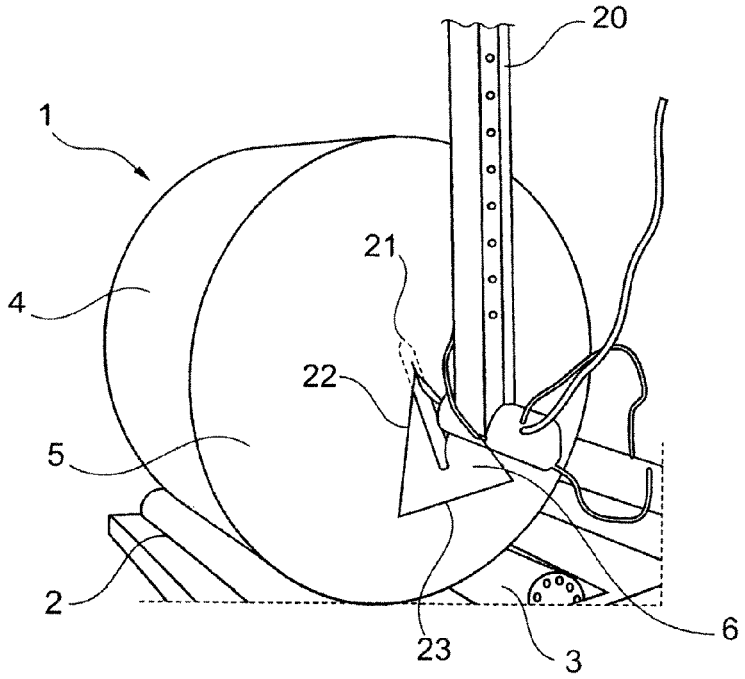
FIG. 6 is a photographic representation of parts of a device according to another embodiment of the present invention.
Figure 7:
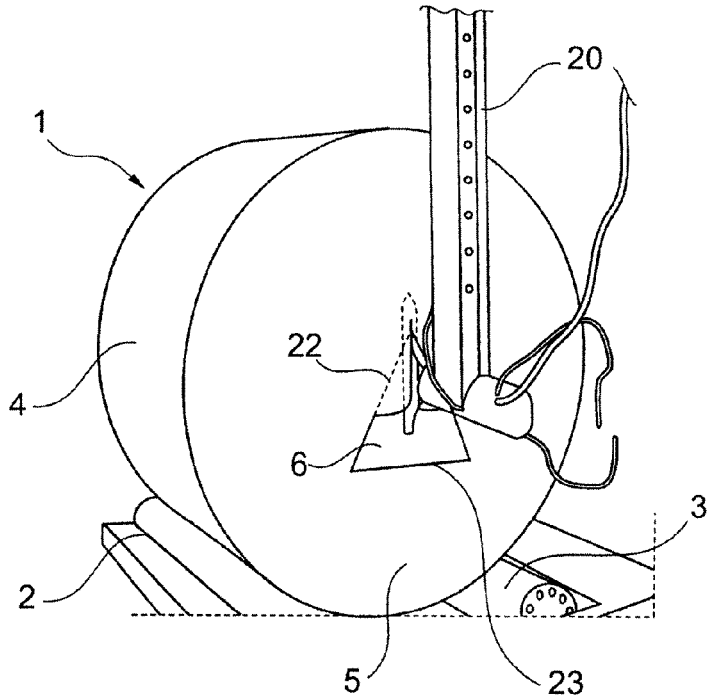
FIG. 7 shows a similar view to that of FIG. 6 with the parts in a different position.
Figure 8:
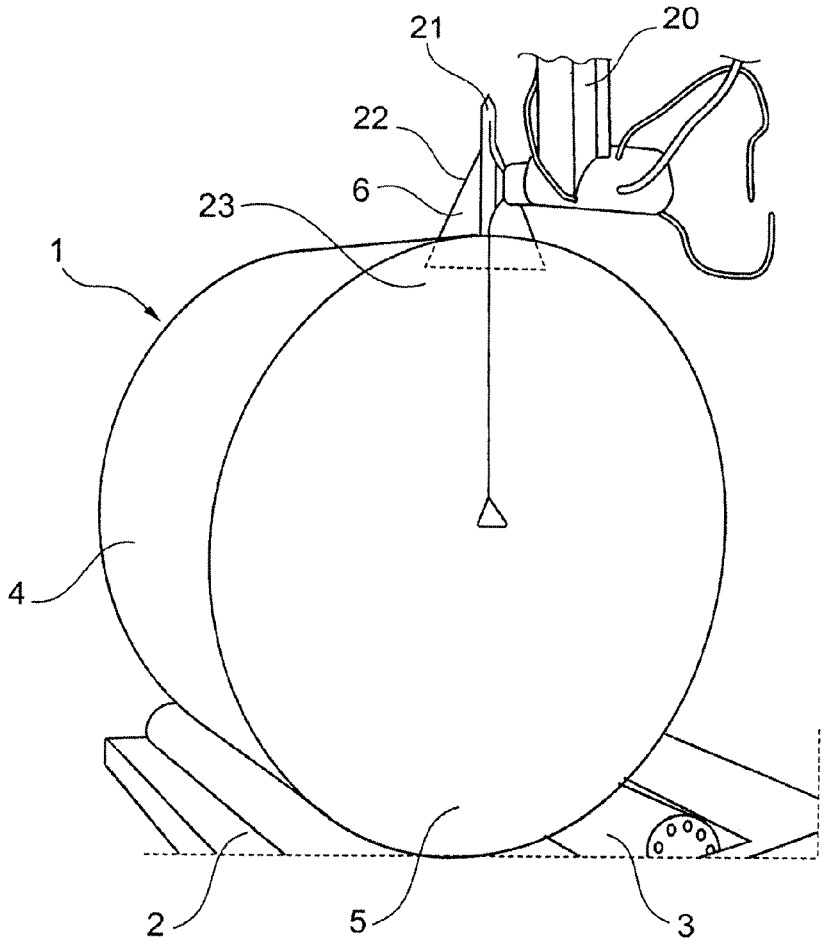
FIG. 8 shows a view similar to that of FIGS. 6 and 7 with the parts in a different position than in FIGS. 6 and 7.

FIGS. 6, 7 and 8 show yet a further prototype of a device according to the present invention, which is in the form of a leg 20 which is vertically displaceable up and down and horizontally to and from the end 5 of the roll 1. At the foot end of the leg 20, the tool 6 is mounted and, in this prototype, is substantially triangular with a slightly projecting tip 21 and acute edges 22 which extend from the tip 21 to the base 23. The tool 6 is mounted on the foot end of the leg 20 in order to be pivotal between a vertical position substantially parallel with the end 5 and an angle of approx. 45° which is exemplified in FIG. 6 to the end 5. This angle may be adapted to suit different conditions and may be selected to be anything between the limits of 0 and 90°.

With this prototype, the stripping of wrapping material commences with the tool 6 being located in its vertical position substantially parallel with the end 5 and with the leg 20 being lowered of displaced to a position inside the periphery of the roll 1 in order, in this position, to be displaced into abutment against the end 5 for determining the position of the end 5. Possibly, the diameter of the roll 1 has been determined previously or is determined simultaneously with the position of the end. The leg 20 with the tool 6 is displace horizontally at least so far from the surface of the end that the tool 6 may be pivoted or switched to the position illustrated in FIG. 6 at an angle of approx. 45° to the surface of the end, whereupon the tip 21 of the tool 6 should be located substantially in the centre of the roll 1 or the surface of the end. The position of the tip 21 may be adjusted by raising or lowering the leg 20.

From this position, the tip 21 of the tool 6 is displaced in the 45° direction to and through the material of the end. After penetration of the material of the end, the 45° displacement ceases while holding the tip 21 under the material of the end, whereafter the tool 6 is pivoted to the vertical position which is illustrated in FIG. 7 in that the leg 20 is displaced towards the end 5 and possibly under a certain lowering of the tool 6 for maintaining the tip 21 in the desired position under the material of the end. In this position, the tip 21 is not to be in contact with or touching the sleeve 11 of the roll 1 or possibly a plug disposed therein. Any contact or touching between the sleeve 11 or plug of the roll 1 could prevent continued displacement or switching of the tool 6 or even cause serious damage to the sleeve 11 or the plug.

From this position according to FIG. 7, the tool 6 is lifted or displaced upwards or outwards towards the periphery of the roll 1 to the position illustrated in FIG. 8 during cutting of the wrapping material of the end. Before this lifting or displacement of the tool 6, it may be appropriate to move the tool 6 slightly away from the end surface of the roll 1 proper in order to avoid risk of damage thereto.

With the tool 6 in the position illustrated in FIG. 8, the roll 1 is rotated at least one revolution for cutting off the wrapping material of the end against the edge 22 on the tool 6 from the casing wrapping material so that the end wrapping material may be removed.

With a leg 20 and a tool 6 at the other end 5 of the roll 1, the other end wrapping material may be removed, or the roll 1 may be rotated half a revolution for further processing. The casing 4 may be removed immediately after the ends 5, or it may be removed later.

Many modifications of the above described embodiments of the device and method according to the present invention are naturally possible without departing from the scope of the inventive concept as defined in the appended Claims.

The invention claimed is:

1. A method for stripping of wrapping material, comprising ends of a casing on a substantially cylindrical roll of paper and a pendulum having a tool mounted to the pendulum, the tool comprising a first tool portion, a second tool portion, and a third tool portion, wherein an end of the wrapping material is opened in that the first tool portion is pivoted to a central position on an end surface for penetration of the end of the wrapping material and is thereafter pivoted to a second position for processing of the end of the wrapping material by cutting of the end of the wrapping material in a direction out towards the periphery of the end where the end of the wrapping material connects to the casing of the wrapping material, and the end is separated from the casing by the first tool portion or the second tool portion by cutting with the tool in the second position during rotation of the roll and/or displacement of the first tool portion or the second tool portion around the periphery of the end.

2. The method as claimed in claim 1, wherein the casing material is opened from the one end of the roll to an other end by the first tool portion or the second tool portion or the third tool portion by cutting during displacement of the tool and/or the roll substantially parallel with the longitudinal axis of the roll.

3. The method as claimed in claim 2, wherein the casing material is opened after separation of the one end or simultaneously with the second end.

4. The method as claimed in claim 1, wherein the cutting of the wrapping material extending to and out over the end of the roll and located at the periphery of the end by the first tool portion or the second tool portion is commenced when the first tool has reached up to and broken through the wrapping material extending to and out over the end of the roll and located at the periphery of the end.

5. The method as claimed in claim 1, wherein prior to engagement in the end by the first tool portion, a pressure difference is established via suction cups between the surroundings of the roll provided with wrapping material and the interior of the roll for lifting of the wrapping material from the roll.

6. The method as claimed in claim 1, wherein the end is lifted or drawn out from the end surface of the roll before the first tool portion is brought into engagement in and through the end wrapping material.

7. The method as claimed in claim 1, wherein the ends are opened separately.

8. A device for carrying out the method as claimed in claim 1, comprising:

a plate;

an arm mounted to the plate, the arm including a suction cup; and a pendulum mounted to the plate, the tool being disposed on the pendulum, wherein the first tool portion is provided for pivoting to a first position and penetration of the end wrapping material on the roll, pivoting to a second position for displacement to the wrapping material extending to and out over the end of the roll and located at the periphery of the end for cutting of the packaging material, the first tool portion and/or the second tool portion is disposed, in its second position, to separate the end from the casing by cutting of the wrapping material in a region between the end and the casing during rotation of the roll and/or displacement of the tool around the periphery of the end for separating thereof from the casing.

9. The device as claimed in claim 8, wherein the first tool portion, the second tool portion and/or a third tool portion of the tool is disposed on the pendulum to open the casing from the one end of the roll to the other end of the roll by cutting of the wrapping material in the casing during displacement of the tool and/or the roll.

10. The method as claimed in claim 2, wherein the cutting of the wrapping material extending to and out over the end of the roll and located at the periphery of the end by the first tool portion or the second tool portion is commenced when the first tool has reached up to and broken through the wrapping material extending to and out over the end of the roll and located at the periphery of the end.

11. The method as claimed in claim 3, wherein the cutting of the wrapping material extending to and out over the end of the roll and located at the periphery of the end by the first tool portion or the second tool portion is commenced when the first tool portion has reached up to and broken through the wrapping material extending to and out over the end of the roll and located at the periphery of the end.

* * * * *